US007895875B2

(12) United States Patent
Dickson et al.

(10) Patent No.: US 7,895,875 B2
(45) Date of Patent: Mar. 1, 2011

(54) METHODS AND SYSTEMS FOR REDUCING TENSILE RESIDUAL STRESSES IN COMPRESSED TUBING AND METAL TUBING PRODUCTS PRODUCED FROM SAME

(75) Inventors: John A. Dickson, Newtown Square, PA (US); Dan Gadbery, West Lafayette, IN (US); Duane Bendzinski, Howell, MI (US)

(73) Assignee: Alcoa Inc., Pittsburgh, PA (US)

( * ) Notice: Subject to any disclaimer, the term of this patent is extended or adjusted under 35 U.S.C. 154(b) by 492 days.

(21) Appl. No.: 11/847,967

(22) Filed: Aug. 30, 2007

(65) Prior Publication Data

US 2008/0053183 A1 Mar. 6, 2008

Related U.S. Application Data

(60) Provisional application No. 60/824,036, filed on Aug. 30, 2006.

(51) Int. Cl.
*B21D 41/00* (2006.01)
*B21C 37/30* (2006.01)

(52) U.S. Cl. ..... 72/370.13; 72/370.02; 72/370.1; 72/370.25

(58) Field of Classification Search ..... 72/367.1, 72/370.01, 370.02, 370.06, 370.07, 370.1, 72/370.13, 370.24, 370.25, 283, 278, 284, 72/264, 265, 266, 392, 393, 115
See application file for complete search history.

(56) References Cited

U.S. PATENT DOCUMENTS

| | | | | |
|---|---|---|---|---|
| 3,479,030 | A | 11/1969 | Merola | 72/273 |
| 3,779,064 | A * | 12/1973 | Besson | 72/283 |
| 3,854,316 | A | 12/1974 | Wilson | 72/370 |
| 5,607,524 | A | 3/1997 | Klemp et al. | 148/521 |
| 5,637,042 | A | 6/1997 | Breese | 464/183 |
| 5,643,093 | A | 7/1997 | Breese | 464/183 |
| 5,951,794 | A | 9/1999 | Dickson, Jr. | 148/690 |
| 6,159,315 | A | 12/2000 | Haszler et al. | 148/697 |
| 6,247,346 | B1 | 6/2001 | Dickson, Jr. | 72/370.13 |
| 7,062,948 | B2 * | 6/2006 | Beagle | 72/370.02 |
| 7,163,076 | B2 | 1/2007 | Seksaria et al. | 180/291 |

FOREIGN PATENT DOCUMENTS

| | | |
|---|---|---|
| EP | 0188086 | 7/1986 |
| GB | 2068857 | 8/1981 |

OTHER PUBLICATIONS

International Search Report and Written Opinion from corresponding International Application No. PCT/US2007/077270.
*Standard Practice for Estimating the Approximate Residual Circumferential Stress in Straight Thin-walled Tubing*, ASTM, Designation: E, pp. 1928-1999, West Conshohocken, PA.

* cited by examiner

*Primary Examiner* — Debra M Sullivan
(74) *Attorney, Agent, or Firm* — Greenberg Traurig, LLP

(57) ABSTRACT

Methods and systems for reducing the stress state of compressed ends of compressed tubes are disclosed. The methods and systems may provide a reduced tensile residual stress state, or even a compressive residual stress state. Tube products produced from the same are also provided.

5 Claims, 4 Drawing Sheets

30
32
12
10
20
30
10
20
T2
T1
14
10
20
PRIOR ART 30
39
32
31
36
35
33
38
34
44
40
11
42
10
12
20
M
14
18
13

METHODS AND SYSTEMS FOR REDUCING TENSILE RESIDUAL STRESSES IN COMPRESSED TUBING AND METAL TUBING PRODUCTS PRODUCED FROM SAME

CROSS-REFERENCE TO RELATED APPLICATIONS

This patent application claims priority to U.S. Provisional Patent Application No. 60/824,036, filed Aug. 30, 2006, and entitled, "METHODS AND SYSTEMS FOR REDUCING FORMING INDUCED TENSILE RESIDUE STRESS IN COMPRESSED TUBING", which is incorporated herein by reference. This patent application is also related to PCT Patent Application No. PCT/US07/77270, filed Aug. 30, 2007, which is incorporated herein by reference.

BACKGROUND OF THE INVENTION

Substituting large diameter, one-piece aluminum drive shafts for conventional two-piece steel constructions has become a popular means of reducing NVH (Noise, Vibration, and Harshness), cost, and weight in passenger car and light truck drive lines. In order to make use of common yokes or end fitting configurations, tubes ends are generally reduced in size via swaging to an inside diameter that appropriately matches the end fittings' mating surface.

A conventional system for reducing a tube end using a swaging process is illustrated in FIGS. 1(*a*)-1(*c*). Generally, a tube 10 is interconnected to a clamp 20, which fixedly positions the tube 10 in a predetermined orientation, as illustrated in FIG. 1(*a*). A push point swage die 30, having a swaging diameter 32 less than a diameter 12 of the tube 10, is pushed onto an end of the tube 10, thereby compressing that portion of tube 10 to the diameter 32 of the swage die 30, as illustrated in FIG. 1(*b*). The swage die 30 is then removed from the tube 10 to provide a compressed end portion 14 of the tube 10 as illustrated in FIG. 1(*c*). The compressed end portion 14 generally has residual tensile stress, such as a tensile residual axial stress $T_1$ and/or a tensile residual hoop stress $T_2$.

In metal forming, "spring back" occurs after process defined deformation. The amount of spring back is a function of, among others, the material's dimensions, yield strength, tooling design, and degree of deformation as plotted against the respective material's stress strain curve. In the case of swaged drive shaft tubing, the diameter reduction may create tensile hoop and/or axial residual stress states, as illustrated above. In some cases, the degree of diameter reduction can impart a tensile residual stress state in the swaged portion that adversely effects weld quality, design interference fit, and the fatigue performance of the drive shaft.

Thermal techniques are known for treating wrought aluminum products having forming induced stress, such as those induced via swaging processes, but such thermal techniques are generally not effective in relieving stress without substantially reducing the mechanical properties of the material.

SUMMARY OF THE INVENTION

Broadly, the instant invention relates to methods and systems for reducing the stress state of compressed ends of a compressed aluminum tube with restricted or no loss of mechanical strength. The instant methods and systems may provide a reduced tensile residual stress state, or even a compressive residual stress state, after compression, which may improve weld quality while maintaining design interferences and mechanical transfer of torque.

In one aspect, aluminum alloy tubes having compressed, but stress-relieved ends are provided. In one approach, an aluminum alloy tube includes a middle portion and an end portion are disclosed. In one embodiment, the end portion comprises a diameter that is smaller than a diameter of the middle portion, and the end portion has a residual hoop stress of less than about 0 ksi. In one embodiment, the aluminum alloy is a series 6061 alloy. In one embodiment, the aluminum alloy tube is suited for use as a drive shaft in an automotive application. In one embodiment, internal surfaces of the stress-relieved end are substantially free of grain profiling.

In another aspect, systems for producing tubes having stress-relieved ends are provided. In one approach, a system includes a tube, a swaging die and an expander. In one embodiment, the tube has a first end portion and the swaging die has an inner portion adapted to compress the first end portion of the tube to a compressed end. In this regard, the compressed end has a diameter that is smaller than a diameter of the first end portion. In one embodiment, the expander has a head and a rod rigidly interconnected with the head, and the head is capable of expanding the compressed end to produce a stress-relieved end (e.g., via extraction from the tube). In one embodiment, the outermost diameter of the head is smaller than the diameter of the first end portion. In one embodiment, the outermost diameter of the head is larger than the diameter of the compressed end. Thus, as the head is extracted, a stress-relieved end may be produced, and the stress-relieved end may have a diameter that is slightly larger than a diameter of the compressed end. In one embodiment, a diameter of the stress-relieved end is at least about 0.04% larger than a diameter of the compressed end.

In one approach, the stress-relieved end has a residual stress state that is less than the residual stress state of the compressed end. In one embodiment, the stress-relieved end has a residual stress state that is 25% less than the residual stress state of the compressed end. In one embodiment, the compressed end has a tensile residual hoop stress and the stress-relieved end has a compressive residual hoop stress. In one embodiment, the compressed end has a residual hoop stress of greater than 0 ksi. In one embodiment, the stress-relieved end has a residual hoop stress of less than 0 ksi. In one embodiment, the stress-relieved end has a residual hoop stress of less than about −1.0 ksi.

The rod may be used to extract the head from the tube. In one embodiment, a portion of the rod extends out of an end of the tube. In one embodiment, the rod is adapted to protrude through a passageway of the swaging die.

The produced tubes having at least one stress-relieved end may be used in a variety of applications. In one embodiment, the tube comprising the stress-relieved end is suited for use as a drive shaft in an automotive application.

In another aspect, methods of producing tubes are provided. In one approach, a method includes inserting a portion of an expander into a tube, compressing a first end portion of the tube thereby producing a compressed end of the tube, extracting the expander from the tube through the compressed end, and moving, concomitant to the extracting step, internal surfaces of the compressed end via the expander, thereby creating a stress-relieved end of the tube. In one embodiment, the moving internal surfaces step includes at least one of (i) outwardly stretching internal surfaces of the compressed end of the tube via the expander, and (ii) outwardly expanding internal surfaces of the compressed end of the tube via the expander. In one embodiment, the moving internal surfaces step includes moving at least some of the internal surfaces toward a distal end of the tube, the distal end being associated with the first end portion of the tube. In one embodiment, the moving internal surfaces step comprises moving at least some of the internal surfaces away from a center axis of the tube. In one embodiment, the compressed end comprises a first residual stress after the compressing step. In one embodiment, the stress-relieved end portion comprises a second residual stress after the extracting step, where the first residual stress of the compressive end is greater than the second residual stress of the stress-relieved end. In one embodiment, the compressed end comprises a residual hoop stress of at least 0 ksi. In one embodiment, the stress-relieved end comprises a residual hoop stress of less than 0 ksi.

To facilitate the extracting step, the method may include applying force to a rod of the expander, where at least a portion of the rod is accessible after the compressing step. In one embodiment, prior to the applying force step, at least a portion of the rod is located outside the tube. In one embodiment, the expander includes a head, and the head is adapted to complete the inserting a portion of the expander step without restrictively engaging the internal surfaces of the first end portion of the tube. In one embodiment, the methods result in the production of an aluminum alloy tubing product.

BRIEF DESCRIPTION OF THE DRAWINGS

FIG. 1(*b*) is a schematic view of the system of FIG. 1(*a*) illustrating the production of a compressed end via a die.

FIG. 1(*c*) is a schematic view of the system of FIG. 1(*a*) illustrating the produced tube and stress states after the die has been removed from the end of a tube.

FIG. 2(*b*) is a schematic view of the system of FIG. 2(*a*) illustrating the production of a compressed end via a die.

FIG. 2(*c*) is a schematic view of the system of FIG. 2(*a*) illustrating the produced compressed end.

FIG. 2(*d*) is a schematic view of the system of FIG. 2(*a*) illustrating production of a stress-relieved end via removal of an expander.

FIG. 2(*e*) is a schematic view of the system of FIG. 2(*a*) illustrating the produced tube and stress states after removal of the expander.

DETAILED DESCRIPTION

Figures 2A, 2B, 2C:
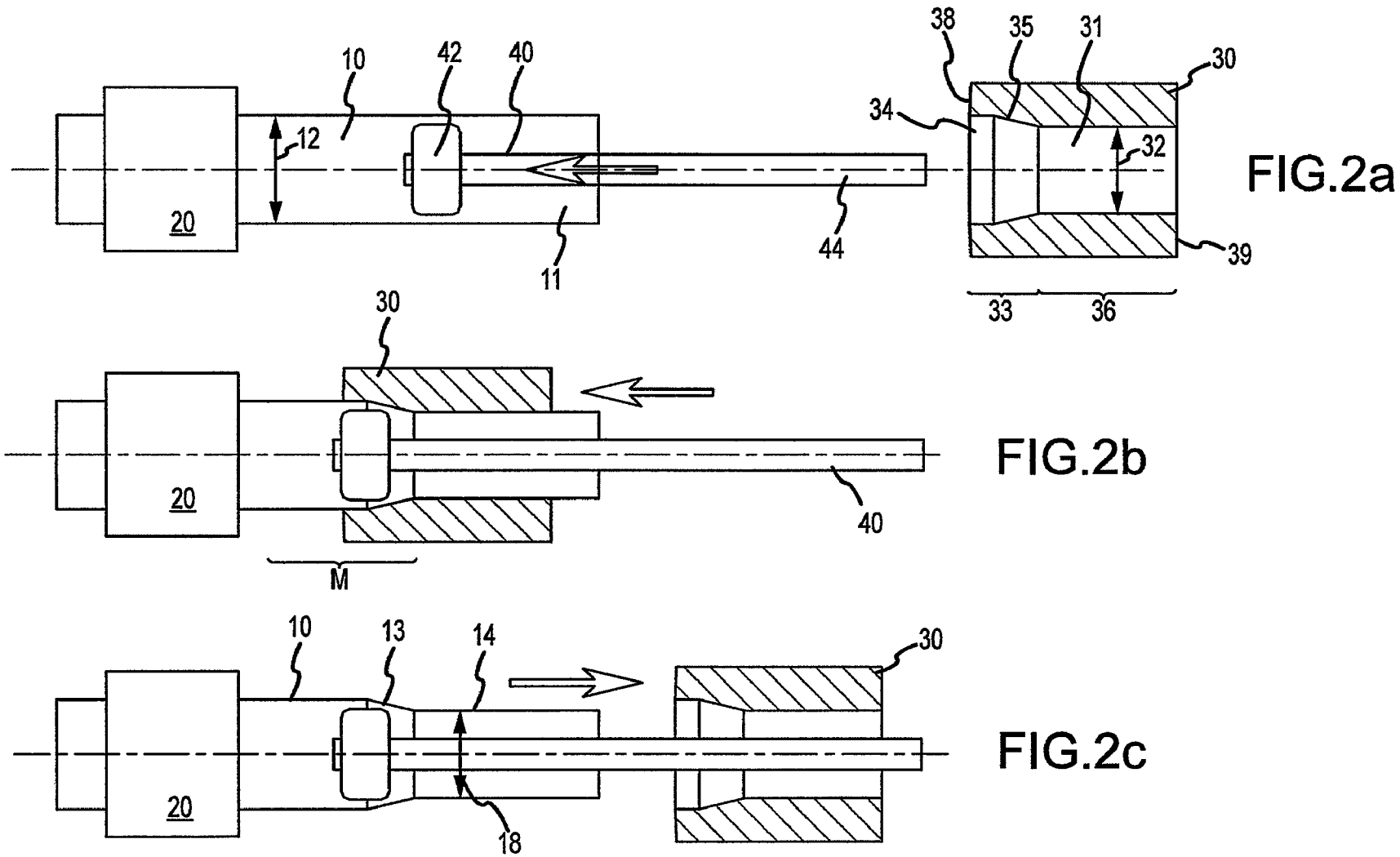
FIG. 2(*a*) is a schematic view of one embodiment of a system for producing stress-relieved tubing ends in accordance within the instant application.
Figure 2D:
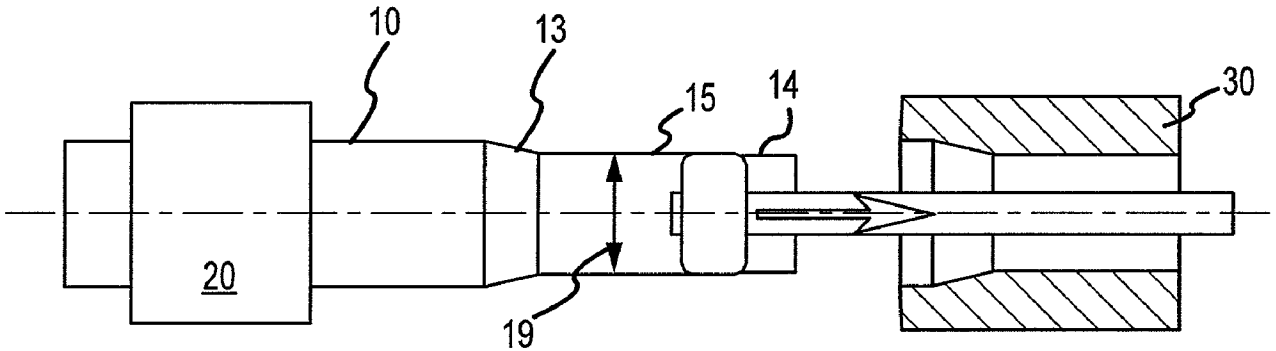
Figure 2E:
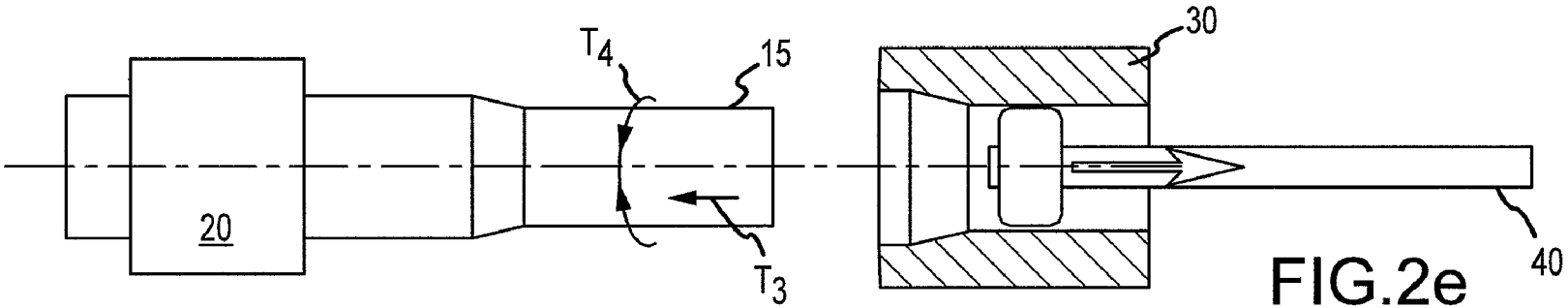

Reference will now be made to the accompanying drawings, which at least assist in illustrating various pertinent features of the instant application. One embodiment of a system for forming a stress-relieved tubing end in accordance with the instant application is illustrated in FIGS. 2(*a*)-2(*e*). In FIG. 2(*a*), an aluminum tube 10 of generally equally cross-section and having an inner diameter 12 is interconnected with clamp 20. Clamp 20 may fixedly position tube 10 in a predetermined orientation. An expander 40 having a head 42 and a rod 44 may be inserted into and through a first end portion 11 of the tube 10. The head 42 may have an outermost diameter that is smaller than the inner diameter 12 of the tube 10. The head 42 may be coaxially aligned with a center axis of the tube 10. The rod 44 of the expander 40 may extend from the head 42 and through tube 10 and out of first end portion 11. Thus, after compression of first end portion 11, as described below, forces may be applied to rod 44 to remove head 42 from the tube 10.

The system also includes a swaging die 30 for producing a compressed end of the tube 10. The swaging die 30 generally comprises internal surfaces for compressing the first tubing end 11, such as a passageway 31 extending between a proximal end 38 of the die and a distal end 39 of the die 30. The passageway 31 generally comprises a proximal end portion 33 and a distal end portion 36 having a diameter 32. The proximal end portion 33 generally comprises a receiving portion 34 and a tapered portion 35. The receiving portion 34 is adapted to receive/is capable of receiving the first end portion 11 of the tube 10. The tapered portion 35 comprises a distal end that has a diameter coincidental to the diameter 32 of the distal end portion 36. The tapered portion 35 is adapted to compress/is capable of compressing the first end portion 11 of the tube 10 to produce compressed end 14 and transition zone 13 (FIG. 2(*b*)).

In particular, and with reference to FIGS. 2(*a*)-2(*c*), as swage die 30 is pushed onto and about the first end portion 11 of the tube 10 (e.g., toward middle portion M), tapered portion 35 compresses the first end portion 11 of the tube 10 to a size corresponding with diameter 32 of the swage die 30. In turn, the swage die 30 is removed from the tube 10, thereby leaving the compressed end 14 and the transition zone 13. Compressed end 14 generally comprises a tensile residual stress, which may be a tensile residual axial stress and/or a tensile residual hoop stress. Compressed end portion 14 generally comprises an inner diameter 18, which is smaller than inner diameter 12 of non-compressed portions of tube 10. Head 42 is generally located in a middle portion M of tube 10 (or even further away from compressed end) during the compression of first tubing end 11 so as to avoid interference with the production of compressed end 14.

To at least partially relive the tensile residual stress of compressed end 14, the expander 40 is removed from the tube 10. In particular, and as illustrated in FIG. 2(*d*), rod 44 may be pulled in a distal direction to force head 42 through the transition zone 13 and compressed end 14 of tube 10. As the head 42 passes through the compressed end 14, it moves (e.g., stretches and/or expands) internal surfaces of the compressed end 14, thereby creating stress-relieved end 15. In this regard, head 42 may be sized to have an outermost diameter that is slightly larger than the inner diameter 18 of the compressed end portion 14. After extraction from the tube 10, the expander 40 may be removed from the swage die 30, as illustrated in FIG. 2(*e*).

As illustrated in FIGS. 2(*c*) and 2(*d*), the compressed end 14 generally has a diameter 18 that is slightly smaller than the diameter 19 of the stress-relieved end 15. For example, the diameter 18 of the compressed end 14 may be in the range of from about 0.04% to about 1.4% smaller than the diameter 19 of the stress-relieved end 15. Thus, use of the expander may result in expansion of the compressed end 14 by from about 0.04% to about 1.4% to produce stress-relieved end 15. In one embodiment, the diameter 19 is at least about 0.05% larger than diameter 18. In other embodiments, the diameter 19 is at least about 0.1% larger than diameter 18, such as at least about 0.2% larger, or even at least about 0.3% larger, or even at least about 0.4% larger, or even at least about 0.5% larger, or even at least about 0.6% larger, or even at least about 0.7% larger than diameter 18 of compressed end 14. In one embodiment, the diameter 19 is not greater than about 1.4% larger than diameter 18. In other embodiments, the diameter 19 is not greater than about 1.35% larger than diameter 18, such as not greater than about 1.3% larger, or even not greater than about 1.2% larger, or even not greater than about 1.1% larger, or even not greater than about 1.0% larger than the diameter 18 of compressed end 14.

As described below, the inner diameter 19 and outer diameter of the stress-relieved end 15 may be selected in accordance with predetermined design criteria. In turn, the inner diameter 18 and outer diameter of the compressed end 14 may be selected in advance and in conjunction with a selected percentage increase between the diameters of the stress-relieved end and the diameters of the compressed end (e.g., the above-described percentage increase). In turn, die 30 and expander 40 may correspondingly be selected.

The stress-relieved end 15 generally has reduced tensile stress relative to the compressed end portion 14, and in some cases has a reversed stress field relative to the compressed end portion 14 (e.g., a compressive axial stress field $T_3$ and/or a compressive hoop stress field $T_4$). For instance, the stress-relieved end 15 may comprise a residual stress state that is at least about 25% less than the residual stress state of the compressed end 14 as determined using ASTM E1928-99 (hereinafter "the Espey and Sachs method"). In one embodiment, the stress-relieved end 15 comprises a residual stress state that is at least about 35% less than the residual stress state of the compressed end 14 as determined using the Espey and Sachs method. In other embodiments, the stress-relieved end 15 comprises a residual stress state that is at least about 50% less than the residual stress state of the compressed end 14, such as at least about 60% less, or even at least about 70% less, or even at least about 80% less, or even at least about 90% less, or even at least about 100% less than the residual stress state of the compressed end 14 as determined using the Espey and Sachs method.

In some instances, the stress-relieved end 15 may comprise a compressive stress state, as opposed to the tensile stress state of compressed end 14. For example, the stress-relieved end 15 may comprise a residual stress of less than 0 ksi as measured by the Espey and Sachs method. In one embodiment, the stress-relieved end 15 comprises a residual hoop stress of not greater than about −1.0 ksi as measured by the Espey and Sachs method. In other embodiments, the stress-relieved end 15 comprises a residual hoop stress of not greater than about −1.25 ksi, or not greater than about −1.5 ksi, or not greater than about −1.75 ksi, or not greater than about −1.90 ksi as measured using the Espey and Sachs method.

The head 42 of the expander 40 may be of any suitable shape. In general, the shape of the head 42 is generally coincidental to the shape of the tube 10. In the illustrated embodiments, the head 42 is of a generally torus configuration, but the head 42 may also be of a cylindrical or other configuration. In any event, the outermost diameter/perimeter of the head 42 should be sized such that the head 42 may readily/freely enter tube 10 prior to producing compressed end 14. Furthermore, the size of head 42 should be such that, as head 42 is extracted from tube 10, outer surfaces of head 42 engage inner surfaces of compressed end portion 14 so as to move (e.g., expand and/or stretch) at least a portion of the inner surfaces (e.g., expand and/or stretch) of compressed end portion 14, and create stress-relieved end 15.

The expander 40 may be any suitable apparatus for expanding the compressed end portion 14 of the aluminum tube 10 after swaging. In the illustrated embodiments, the expander 40 comprises the head 42 and the rod 44 rigidly interconnected with the head 42. In another embodiment, the expander 40 may comprise a bladder, such as those used in conjunction with a hydroforming process. In another embodiment, the expander 40 may comprise plugs (e.g., urethane plugs) adapted to push against separate inner portions of the compressed end 14 as the plugs are removed from the tube 10. In one embodiment, the expander 40 is an expansion means capable of moving internal surfaces of a compressed end 14 of a tube 10, thereby reducing the stress state of the compressed end 14. The expansion means may be any suitable apparatus in this regarding, including any one of a mandrel, a bladder, and a plug.

The tube 10, swage die 30 and expander 40 are generally sized in accordance with the desired final dimensions of the compressed tube end 14. In one embodiment, the tube 10, swage die 30 and expander 40 are sized such that the tubing product has outer and/or inner surfaces (e.g., perimeter, diameter, surface area) that are in accordance with a predetermined design parameter. For example, the tube 10 and the swage die 30 may be sized to compress a tube end to an outer and/or inner size that is slightly smaller than the design requirements of the final tubing product. In turn, the expander 40 may be sized to expand and/or stretch this compressed end so that the resultant stress-relieved tube end has an outer and/or inner size that is within tolerable limits of the design requirements of the final tubing product.

The tube 10 may consist essentially of aluminum, or may be an aluminum-containing alloy. In particular, the tube 10 may comprise any of the 1XXX, 2XXX, 3XXX, 4XXX, 5XXX, 6XXX, 7XXX or 8XXX series alloys, as defined by The Aluminum Association, Inc. In one embodiment, the tube 10 comprises a 6061 series alloy. It is anticipated that metals other than aluminum may be used.

As noted, the tube 10 may be of any suitable size. In one embodiment, the outer diameter of the stress-relieved end 15 is in the range of from about 4 inches (about 10.2 cm) to about 6 inches (about 15.2 cm), such as in the range of about 4.5 inches (about 11.4 cm) to about 5.8 inches (about 14.7 cm). In a related embodiment, the inner diameter of the stress-relieved end 15 may be in the range of from about 3.5 inches (about 8.9 cm) to about 4.5 inches (11.4 cm), such as in the range of from about 4 inches (about 10.2 cm) to about 4.35 inches (about 11.0 cm). In a related embodiment, the wall thickness of the stress-relieved end 15 may be in the range of from about 0.08 inch (about 0.203 cm) to about 0.1 inch (0.254 cm), such as in the range of from about 0.083 inch (about 0.211 cm) to about 0.098 inch (about 0.249 cm).

Figure 3:
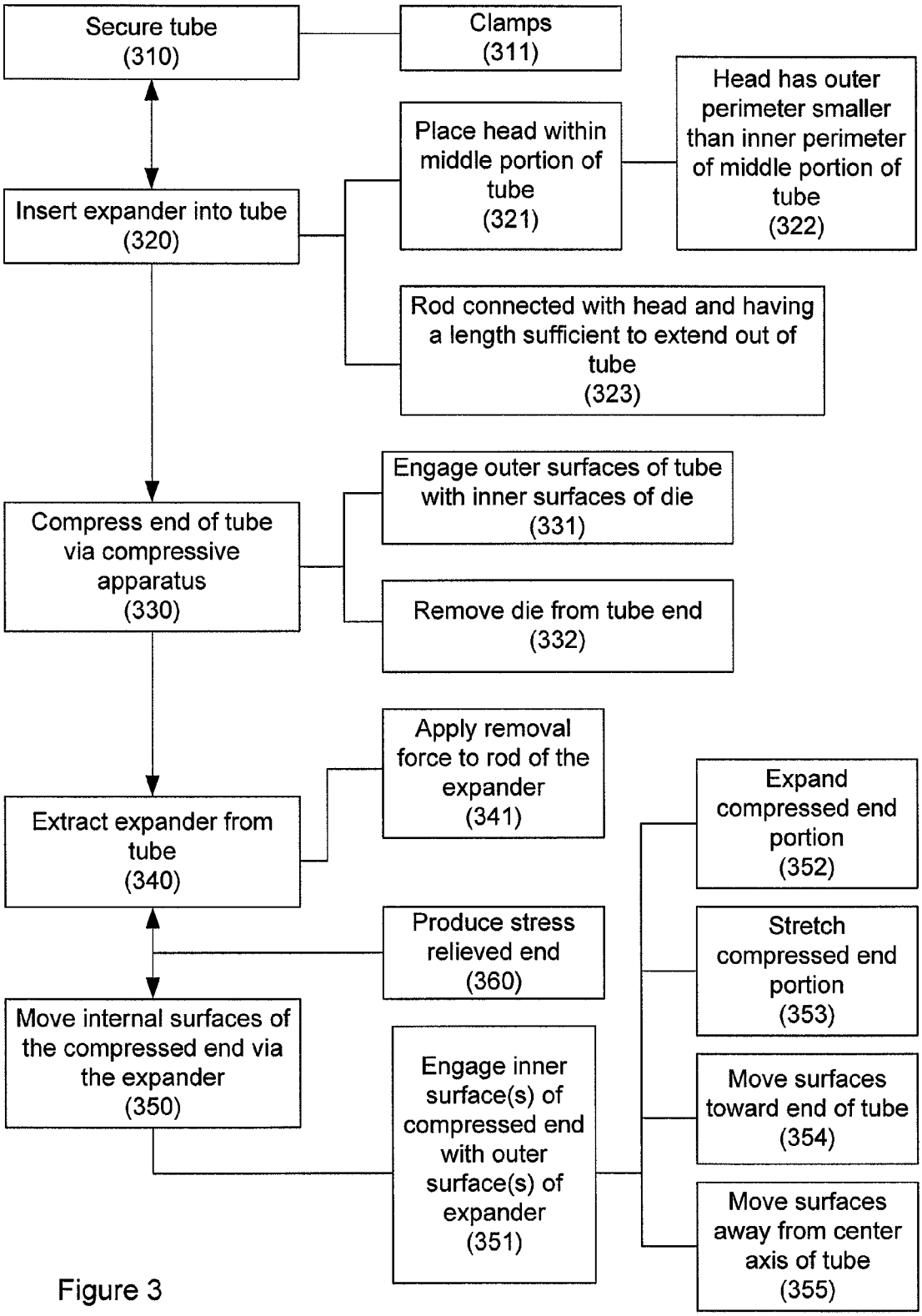
FIG. 3 is a flow chart illustrating one embodiment of a method for producing stress-relieved tubing ends in accordance with the instant application.

FIG. 3 illustrates one embodiment of a method for producing a tubing product. In the illustrated embodiment, the method includes the steps of securing a tube (310), inserting a portion of an expander into the tube (320), compressing an end of the tube via a compressive apparatus (e.g., a die), thereby producing a compressed end of the tube (330), extracting the expander from the tube (340), and, moving, concomitant to the extracting step (340), internal surfaces of the compressed end via the expander (350) to produce a tubing product having a stress-relieved end.

The step of securing the tube (310) may be accomplished in any conventional fashion so long as the tube remains substantially stationary during the compressing the tube end step (330), the extracting the expander step (340) and the moving internal surfaces step (350). In one embodiment, clamps are used to secure the tube (311). In an alternative embodiment (not illustrated), the compressive apparatus and/or the expander may be secured, and the tubing may be moved relative thereto.

The step of inserting the expander into the tube (320) may be accomplished in any conventional fashion. In one embodiment, a head of an expander is placed within the tube (321). In this regard, the head may have a smaller size (e.g., outermost perimeter) than the inner size (e.g., perimeter) of the tube (322). After the inserting step (320), the head is generally located in a middle portion of the tube so as to avoid interfering with the compressing step (330). In one embodiment, a rod may be fixedly/rigidly interconnected with the head and the rod may have a sufficient length to extend out of the end of the tube (323). Thus, after or concomitant with the compressing the tube end step (330), forces may be applied to the rod to accomplish the extracting the expander step (340).

The step of compressing a tube end via a compressive apparatus (330) is generally accomplished by engaging an end of the tube with a die having a swaging portion. For example, the die may be moved toward a center portion of the tube to engage outer surfaces of the tube with inner surfaces of the die (e.g., a swaging portion of the die) (331), thereby compressing the end of the tube into a compressed end. After the compressed end portion is produced, the die may be removed from the tube end (332). In another embodiment (not illustrated), the die is stationary and the tube is moved relative thereto to accomplish the compressing step (330). As may be appreciated, compressive apparatus other than dies may be used to create the compressed end of the tube. For example, rotary swaging, spin forming and/or electromagnetic pulse forming apparatus/systems may be used to create the compressed end.

The step of extracting the expander (340) may include the step of applying a removal force to a rod of the expander (341). Thus, the head of the expander may be extracted from the tube. In this regard, after the compressing step (330), at least a portion of the rod may be located outside of the tube.

Concomitant to the extracting step (340), internal surfaces of the compressed end may be moved via the expander (350). In this regard, the moving step (350) may include engaging one or more inner surfaces of the compressed end with one or more outer surfaces of the expander (e.g., the head) (351) to move the inner surfaces to different positions. For example, the engaging step (351) may expand the compressed end portion (352) and/or stretch the compressed end portion (353) and/or move the inner surfaces toward the distal end of the tube (354) and/or move the inner surfaces away from a center axis of the tube (355). In turn, production of a stress-relieved end from the compressed end (360) may be accomplished. In an alternative embodiment (not illustrated), the expander is stationary and the tube is moved relative thereto to accomplish the expanding step (340) and/or moving step (350).

In addition to the tensile stress reduction benefits, reduced grain profiling on internal surfaces of the tube may be realized. For example, during the compressing step (330), internal portions of the tube may develop a surface condition know as grain profiling (e.g., "orange peel"), which may ultimately result in peak to smooth contact between the tube and yoke in a drive shaft application. With the instant methods, grain profiling may be reduced as the expander may smooth the internal surfaces of the tube during the extraction step (340) and/or moving step (350).

The methods and systems of the instant application may result in a tube product having a tubing end that has a lower stress state than conventionally produced tubing products. The methods and systems are generally useful in conjunction with single-piece aluminum tubes (e.g., single-piece drive shaft tubes). The methods and systems of the instant application are relatively efficient and cost-effective. For example, the additional production time associated with inserting the expander into and extracting the expander from the tubing, relative to conventional swaging processes, is generally only a few seconds (e.g., not greater than 10 seconds). The additional capital cost is also relatively low. Thus, the methods and systems of the instant application are suited for reducing tensile stresses on tubing ends. The methods and systems of the instant application may also be used in drive shaft forming applications, as well as other applications, such as butted bicycle frame tubing, or for aerospace materials, such as torque tubes or control rods, to name a few.

EXAMPLES

Example 1

Production of Tubing End Via Conventional Process

Figures 1A, 1B, 1C:
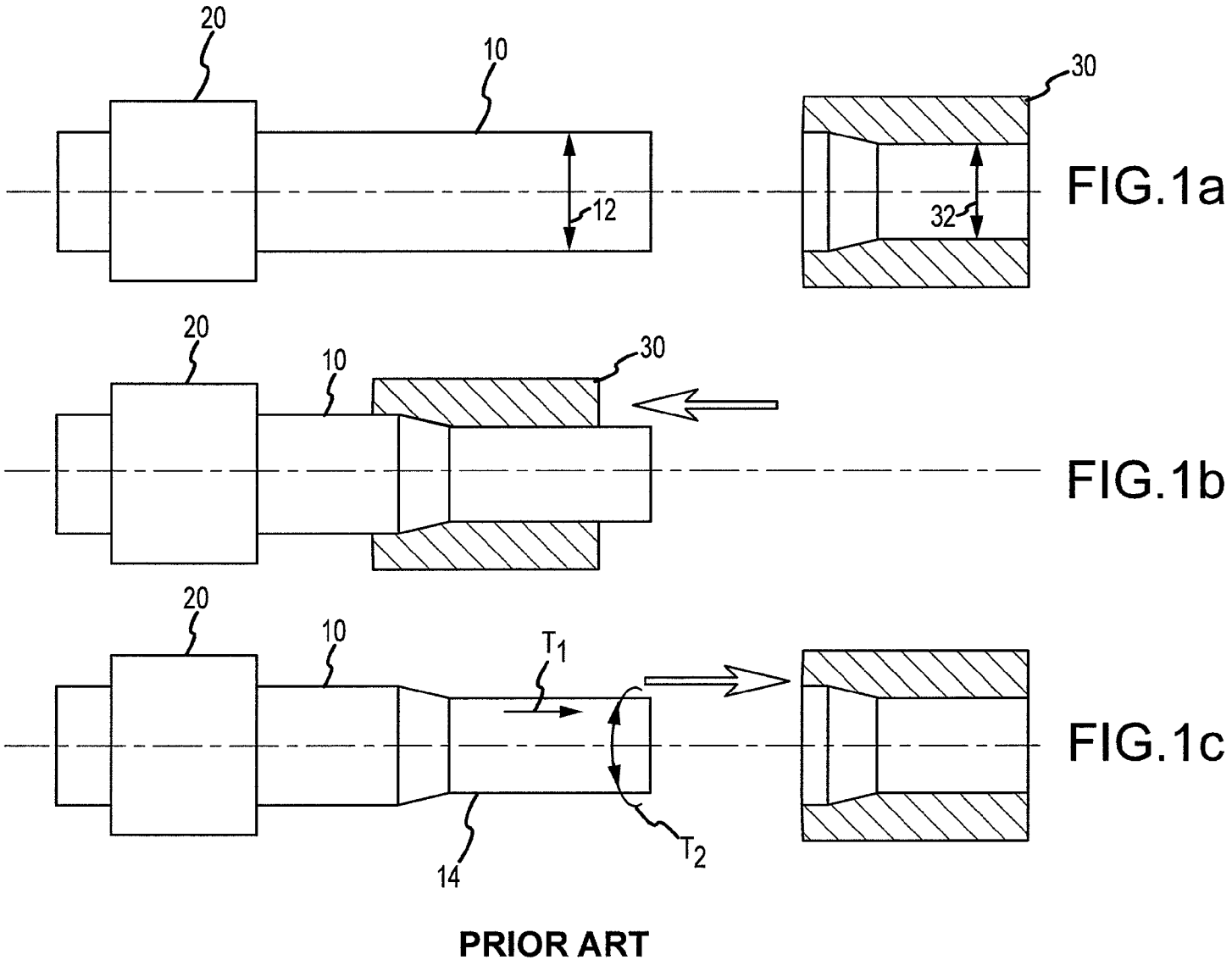
FIG. 1(*a*) is a schematic view of one prior art system of producing a compressed tubing end.

A compressed tubing end of a 6061 series aluminum alloy is produced substantially in accordance with FIGS. 1(*a*)-1(*c*) and the description associated therewith. The residual axial hoop stress of the tubing end is measured via the Espey and Sachs method. The diameter before testing is about 4.528 inches. The diameter after testing is about 4.728 inches. The residual hoop stress is measured to be about 10.17 ksi.

Example 2

Production of Tubing End Via Conventional Process with Subsequent Heat Treatment A compressed tubing end of a 6061 series aluminum alloy is produced substantially in accordance with FIGS. 1(*a*)-1(*c*) and the description associated therewith. After production, the compressed end is heat treated via conventional processes. The residual axial hoop stress of the tubing end is measured via the Espey and Sachs method. The diameter before testing is about 4.532 inches. The diameter after testing is about 4.532 inches. The residual hoop stress is measured to be about 0 ksi.

Example 3

Production of Stress-Relieved Tubing End Via Expander

A compressed tubing end of a 6061 series aluminum alloy is produced substantially in accordance with FIGS. 2(*a*)-2(*d*) and the description associated therewith. After production, the residual axial hoop stress is measured via the Espey and Sachs method. The diameter before testing is about 4.525 inches. The diameter after testing is about 4.492 inches. The residual hoop stress is measured to be about −1.95 ksi.

While the instant application has used a cylindrical tube and the term "diameter" in various instance to facilitate ease of description, the term "diameter" should be construed broadly and is meant to include dimensions of non-cylindrical tubes, as well as the dimensions of the cylindrical tubes illustrated in the instant application. Additionally, the term "tube" is intended to include cylindrical as well as non-cylindrical shapes. Moreover, while various embodiments have been described in detail, it is apparent that modifications and adaptations of those embodiments will occur to those skilled in the art. However, it is to be expressly understood that such modifications and adaptations are within the spirit and scope of the present invention.

What is claimed is:

1. A method comprising:

providing an expander comprising a head and a rod rigidly interconnected with the head;

inserting the head of the expander into a tube, the tube having a first end portion;

compressing the first end portion of the tube via a swaging die after the inserting step, thereby producing a compressed end of the tube;

removing the swaging die from the first end portion;

extracting the expander from the tube through the compressed end, after the removing step; and moving, concomitant to the extracting step, internal surfaces of the compressed end via the expander, thereby creating a stress-relieved end of the tube.

2. The method of claim 1, wherein, after the compressing step, the compressed end comprises a first residual stress, and wherein, after the extracting step, the stress-relieved end portion comprises a second residual stress, wherein the second residual stress is less than the first residual stress.

3. The method of claim 1, wherein, after the compressing step, the stress-relieved end comprises a residual hoop stress of less than 0 ksi.

4. The method of claim 3, wherein the stress-relieved end has a residual hoop stress of less than about −1.75 ksi.

5. The method of claim 1, wherein the extracting step comprises:

applying force to the rod of the expander, wherein at least a portion of the rod of the expander is accessible after the compressing step;

wherein, prior to the applying force step, at least a portion of the rod is located outside the tube;

wherein the head is adapted to complete the moving internal surfaces step; and wherein the inserting the head of the expander step is completed without restrictively engaging the internal surfaces of the first end portion of the tube.

* * * * *